US007276151B1

(12) United States Patent
Okada et al.

(10) Patent No.: US 7,276,151 B1
(45) Date of Patent: Oct. 2, 2007

(54) GAS TURBINE FUEL OIL AND PRODUCTION METHOD THEREOF AND POWER GENERATION METHOD

(75) Inventors: Tsuyoshi Okada, Kanagawa (JP); Yoshinori Mashiko, Kanagawa (JP); Shinichi Tokuda, Kanagawa (JP); Tomoyoshi Sasaki, Kanagawa (JP); Kozo Imura, Aichi (JP); Makoto Inomata, Kanagawa (JP); Toshio Tanuma, Kanagawa (JP)

(73) Assignee: JGC Corporation, Tokyo (JP)

( * ) Notice: Subject to any disclaimer, the term of this patent is extended or adjusted under 35 U.S.C. 154(b) by 0 days.

(21) Appl. No.: 09/807,696

(22) PCT Filed: Sep. 10, 1999

(86) PCT No.: PCT/JP99/04927

§ 371 (c)(1),
(2), (4) Date: Apr. 17, 2001

(87) PCT Pub. No.: WO00/26325

PCT Pub. Date: May 11, 2000

(30) Foreign Application Priority Data

Oct. 30, 1998 (JP) ..... 10-326169
Jan. 19, 1999 (JP) ..... 11-010847
Mar. 30, 1999 (JP) ..... 11-089433

(51) Int. Cl.
*C10G 65/02* (2006.01)

(52) U.S. Cl. ..... 208/210; 208/211; 208/86; 208/89; 208/97; 208/92; 208/15

(58) Field of Classification Search ..... 208/210, 208/211, 86, 89, 97, 15, 92
See application file for complete search history.

(56) References Cited

U.S. PATENT DOCUMENTS 2,775,544 A * 12/1956 Corneil et al. ..... 208/86
2,914,457 A * 11/1959 Beavon ..... 208/79
2,925,374 A * 2/1960 Gwin et al. ..... 208/86
2,945,803 A * 7/1960 Beuther et al. ..... 208/89
3,287,254 A 11/1966 Paterson
3,306,845 A 2/1967 Poll
3,383,300 A * 5/1968 Kimberlin, Jr. ..... 208/211
3,464,915 A * 9/1969 Paterson et al. ..... 208/218

(Continued)

FOREIGN PATENT DOCUMENTS

GB 1205481 3/1967

(Continued)

*Primary Examiner*—Walter D. Griffin
(74) *Attorney, Agent, or Firm*—McDermott Will & Emery LLP

(57) ABSTRACT

Feed oil is subject to atmospheric distillation, to thereby be separated into light oil or light distillate and atmospheric residue oil. The light distillate is catalytically contacted with pressurized hydrogen in the presence of a catalyst, resulting in a first hydrotreating step being executed. In this instance, various fractions of the light distillate produced in the atmospheric distillation are subject to hydrotreating in a lump. The atmospheric residue oil is then separated into a light matter and a heavy matter. The light matter is subject to second hydrotreating in the presence of a catalyst to produce refined oil (light matter), which is mixed with refined oil produced in the first hydrotreating to prepare a mixture. The mixture is used as gas turbine fuel oil.

18 Claims, 13 Drawing Sheets

U.S. PATENT DOCUMENTS

| | | | | | |
|---|---|---|---|---|---|
| 3,801,495 | A | | 4/1974 | Gould | |
| 3,830,731 | A | * | 8/1974 | Reed, Jr. et al. | 208/211 |
| 3,855,113 | A | * | 12/1974 | Gould | 208/89 |
| 3,893,909 | A | * | 7/1975 | Selvidge | 208/211 |
| 4,006,076 | A | | 2/1977 | Christensen et al. | |
| 4,062,758 | A | * | 12/1977 | Goudriaan et al. | 208/80 |
| 4,120,778 | A | * | 10/1978 | Goudriaan et al. | 208/80 |
| 4,126,538 | A | * | 11/1978 | Goudriaan et al. | 208/80 |
| 4,348,288 | A | * | 9/1982 | Yoshinaga et al. | 210/708 |
| 4,400,264 | A | * | 8/1983 | Kwant et al. | 208/68 |
| 4,713,221 | A | * | 12/1987 | Montgomery et al. | 422/190 |
| 4,990,242 | A | * | 2/1991 | Louie et al. | 208/218 |
| 5,851,381 | A | * | 12/1998 | Tanaka et al. | 208/210 |
| 5,958,365 | A | * | 9/1999 | Liu | 423/655 |
| 6,007,703 | A | * | 12/1999 | Morel et al. | 208/210 |

FOREIGN PATENT DOCUMENTS

| | | |
|---|---|---|
| JP | 3-86793 | 4/1991 |
| JP | 6-207179 | 7/1994 |
| JP | 6-209600 | 7/1994 |
| JP | 7-197040 | 8/1995 |
| JP | 8-48981 | 2/1996 |
| JP | 8-183961 | 7/1996 |
| JP | 8-183964 | 7/1996 |
| JP | 9-194852 | 7/1997 |
| JP | 10-2234 | 1/1998 |

* cited by examiner

GAS TURBINE FUEL OIL AND PRODUCTION METHOD THEREOF AND POWER GENERATION METHOD

TECHNICAL FIELD

This invention relates to fuel oil for a gas turbine, and more particularly to gas turbine fuel oil used for power generation by gas turbine, a method for producing such gas turbine fuel oil and a power generation method using such gas turbine fuel oil.

BACKGROUND ART

In general, oil thermal power generation is adapted to generate steam at a high pressure in a boiler using crude oil and/or heavy oil as a fuel for the boiler, to thereby rotate a steam turbine by means of the thus-generated steam, leading to power generation. However, such a system is deteriorated in power generation efficiency. Currently, a high-efficiency large-sized oil-fired boiler is developed, however, it merely exhibits generation efficiency as low as about 40%. Thus, it causes a large part of energy to be outwardly discharged in the form of greenhouse gas without being recovered. In addition, it causes a certain amount of SOx to be present in exhaust gas or flue gas discharged therefrom. Although the exhaust gas is subject to flue gas desulfurization, SOx is partially discharged to an ambient atmosphere, leading to environmental pollution.

Further, a gas turbine combined cycle power generation system is executed which is adapted to drive a gas turbine for power generation using natural gas as a heat source therefor and recover waste heat from high-temperature flue gas or exhaust gas discharged from the gas turbine for production of steam, to thereby drive a steam turbine, leading to power generation. The system comes to notice in the art because it is increased in power generation efficiency, reduced in quantity of CO2 generated per unit power generation and highly reduced in content of SOx and NOx in flue gas. When it uses natural gas as feed gas, it is required to transport it from a gas field to a power generation plant through a pipeline or store LNG and gasify it, followed by combustion of it in the gas turbine. Unfortunately, this leads to an increase in cost of equipment.

In view of the foregoing, a method for producing fuel oil for a gas turbine is proposed as disclosed in Japanese Patent Application Laid-Open Publications Nos. 207179/1994 and 209600/1994. Techniques disclosed in the former Japanese publication are constructed so as to subject low-sulfur crude oil having a salt content adjusted to be 0.5 ppm or less to a separation treatment by atmospheric distillation or vacuum distillation to produce gas turbine fuel oil constituted of a low boiling fraction of 0.05% by weight in sulfur content. Techniques disclosed in the latter Japanese Publication are adapted to heat low-sulfur crude oil using waste heat discharged from a gas turbine and then act hydrogen on the low-sulfur crude oil, to thereby reduce a sulfur and heavy metal content in the crude oil, followed by recovery of crude oil thus refined, which is then used as fuel oil for the gas turbine.

Now, an environmental problem comes to notice in the art. Thus, it is highly required to minimize a content of a sulfur compound in flue gas. This would be solved by employment of a flue gas desulfurization unit. Unfortunately, in power generation using gas turbine fuel oil, arrangement of the flue gas desulfurization unit causes a deterioration in power generation efficiency due to a pressure loss, so that it is required to minimize a sulfur content of gas turbine fuel oil. Thus, the techniques of the former Japanese publication cause the amount of firing of oil to be considerably restricted in the atmospheric distillation or vacuum distillation, to thereby fail to increase the amount of light oil or light distillate to be fed to the gas turbine or the amount of gas turbine fuel oil. This causes yields of gas turbine fuel oil based on crude oil to be as low as a level of 40%, even if Middle East crude oil which has a low sulfur content is used. An increase in firing of oil for the purpose of increasing the yields causes an increase in production of sulfur.

Also, when it is applied to crude oil which is readily available and increased in sulfur content, recovery of light oil or light residue in the same amount causes a sulfur content of the light oil to exceed a specified level, so that it is unsuitable for use as fuel oil for a gas turbine. Thus, it is forced to decrease recovery of the light oil, resulting in application to the crude oil being technically and economically disadvantageous.

The latter Japanese publication discloses techniques of producing hydrogen using methanol as a starting material and subjecting crude oil to hydrotreating with the hydrogen thus produced. However, the techniques are constructed so as to treat crude oil at a low sulfur content, so that application of the techniques to crude oil at a high sulfur content is considerably restricted. Further, the hydrotreating is carried out on crude oil rather than light oil or light distillate obtained by distillation of crude oil, so that it is required to accommodate process conditions to heavy oil or residue contained in crude oil. This requires to increase a reaction temperature, a reaction pressure and reaction time or a period of time during which heavy oil is kept contacted with a catalyst in the reaction. Unfortunately, this causes excessive cracking of light oil in the crude oil, resulting in LPG or the like being contained in a large amount in fuel oil for a gas turbine, so that storage of the fuel oil causes a part thereof to be gasified. This requires to increase pressure resistance of a tank to a significantly high level. Also, the reaction temperature and reaction pressure are caused to be increased, so that a reaction vessel for the hydrotreating is complicated in structure and increased in manufacturing cost. Further, an increase in reaction time requires large-sizing of a catalyst carrier, leading to large-sizing of the reaction vessel and an increase in consumption of a catalyst.

DISCLOSURE OF THE INVENTION

The present invention has been made in view of the foregoing disadvantage of the prior art.

Accordingly, it is an object of the present invention to provide a method for producing gas turbine fuel oil which is capable of producing gas turbine fuel oil from feed oil with increased efficiency.

It is another object of the present invention to provide a power generation method using gas turbine fuel oil thus produced.

In accordance with one aspect of the present invention, a method for producing gas turbine fuel oil from feed oil with increased yields is provided. The method includes an atmospheric distillation step of subjecting crude oil acting as the feed oil to atmospheric distillation to separate the crude oil into light oil and atmospheric residue oil, a first hydrotreating step of contacting the light oil produced in the atmospheric distillation step with pressurized hydrogen in the presence of a catalyst in a lump, to thereby carry out an impurity removal treatment, resulting in obtaining refined oil, and a first separation step of separating the atmospheric residue oil into a light oil matter and a heavy oil matter. The first separation step is selected from the group consisting of vacuum distillation, solvent deasphalting, thermal cracking and steam distillation. The method also includes a second hydrotreating step of contacting the light oil matter produced in the first separation step with pressurized hydrogen in the presence of a catalyst, to thereby carry out an impurity removal treatment, resulting in obtaining refined oil. Gas turbine fuel oil obtained in the first and second hydrotreating steps is 4 cSt or less in viscosity at 100° C., contains alkaline metal in an amount of 1 ppm or less, lead (Pb) in an amount of 1 ppm or less, V in an amount of 0.5 ppm or less, Ca in an amount of 2 ppm or less and sulfur in an amount of 500 ppm or less, and is produced with yields of 65% or more based on the feed oil.

In a preferred embodiment of the present invention, the method also includes a second separation step of separating the heavy oil matter produced in the first separation step into a light oil matter and a heavy oil matter. The second separation step is selected from the group consisting of solvent deasphalting and thermal cracking. The method further includes a third hydrotreating step of refining the light oil matter produced in the second separation step, to thereby obtain refined oil, which is used as the gas turbine fuel oil.

In a preferred embodiment of the present invention, at least two of the first, second and third hydrotreating steps are executed as a common step.

Thus, in the present invention, the first hydrotreating is carried out subsequent to the atmospheric distillation, so that the atmospheric distillation may be executed while taking no notice of the amount of sulfur and metal entering the light oil matter. Also, practicing of the second hydrotreating step after the first separation step permits conditions for the first separation step to be determined so as to increase the amount of light oil matter produced, irrespective of sulfur and metal, so that the gas turbine fuel oil may be produced with increased yields based on the feed oil. The present invention is aimed at gas turbine fuel oil; thus, the first hydrotreating is executed merely by subjecting a plurality of light oil fractions produced in the atmospheric distillation column to hydrotreating in a lump, resulting in a cost of equipment being reduced.

The gas turbine fuel oil of 4 cSt in viscosity at 100° C. exhibits satisfactory combustion properties. Also, metal and sulfur contained in the gas turbine fuel oil are in a trace amount, so that combustion of the fuel oil may be carried out at a temperature as high as about 1300° C.

In a preferred embodiment of the present invention, the method further includes a fourth hydrotreating step of contacting the heavy oil matter produced in the first separation step with pressurized hydrogen in the presence of a catalyst, to thereby carry out an impurity removal treatment and cracking a part of the heavy oil matter, resulting in obtaining refined oil and a heavy oil matter. The refined oil produced in the fourth hydrotreating step is used as the gas turbine fuel oil.

The first separation step may be replaced with a hydrotreating step (fifth hydrotreating step). In this instance, the method may further includes a third separation step of separating the heavy oil matter produced in the fifth separation step into a light oil matter and a heavy oil matter. The third separation step is selected from the group consisting of vacuum distillation, solvent deasphalting and thermal cracking. The light oil matter produced in the third separation step is used as the gas turbine oil.

In a preferred embodiment of the present invention, the gas turbine fuel oil is further subject to atmospheric distillation, to thereby provide light gas turbine fuel oil and heavy gas turbine fuel oil heavier than the light gas turbine fuel oil. The heavy oil matter produced in the last separation step or the heavy oil matter produced in the fourth hydrotreating step may be used as fuel oil for a boiler.

In the present invention, a material for hydrogen is not limited to any specific one. In a preferred embodiment of the present invention, the heavy oil matter obtained from the feed oil may be partially oxidized by oxygen to produce hydrogen, which may be used in the hydrotreating steps. The heavy oil matter which is produced in the first separation step may be used for this purpose.

Also, in accordance with this aspect of the present invention, a method for producing gas turbine fuel oil from feed oil with increased yields is provided. The method includes a first separation step of separating heavy feed oil consisting of atmospheric residue oil obtained by atmospheric distillation of crude oil and/or heavy oil into a light oil matter and a heavy oil matter. The first separation step may be selected from the group consisting of vacuum distillation, solvent deasphalting, thermal cracking and steam distillation. Also, the method includes a second hydrotreating step of contacting the light oil matter produced in the first separation step with pressurized hydrogen in the presence of a catalyst, to thereby carry out an impurity removal treatment, resulting in obtaining refined oil. The gas turbine fuel oil which is refined oil thus obtained is 4 cSt or less in viscosity at 100° C., contains alkaline metal in an amount of 1 ppm or less, lead in an amount of 1 ppm or less, V in an amount of 0.5 ppm or less, Ca in an amount of 2 ppm or less and sulfur in an amount of 500 ppm or less, and is produced with yields of 40% or more based on the heavy feed oil.

In a preferred embodiment of the present invention, the method may further includes a second separation step of separating the heavy oil matter produced in the first separation step into a light oil matter and a heavy oil matter. The second separation step is selected from the group consisting of solvent deasphalting and thermal cracking. The method further includes a third hydrotreating step of refining the light oil matter produced in the second separation step, to thereby obtain refined oil, which is used as the gas turbine fuel oil.

In a preferred embodiment of the present invention, the method may include a fourth hydrotreating step of contacting the heavy oil matter produced in the first separation step with pressurized hydrogen in the presence of a catalyst, to thereby carry out an impurity removal treatment and cracking a part of the heavy oil matter, resulting in obtaining refined oil and a heavy oil matter, wherein the refined oil produced in the fourth hydrotreating step is used as the gas turbine fuel oil.

Further, in accordance with this aspect of the present invention, a method for producing gas turbine fuel oil from feed oil with increased yields is provided. The method includes a fifth hydrotreating step of contacting heavy feed oil consisting of atmospheric residue oil obtained by atmospheric distillation of crude oil and/or heavy oil with pressurized hydrogen in the presence of a catalyst, to thereby carry out an impurity removal treatment and cracking a part of a heavy oil matter, resulting in obtaining refined oil and a heavy oil matter. The gas turbine fuel oil which is refined oil thus obtained in the fifth hydrotreating step is 4 cSt or less in viscosity at 100° C., contains alkaline metal in an amount of 1 ppm or less, lead in an amount of 1 ppm or less, V in an amount of 0.5 ppm or less, Ca in an amount of 2 ppm or less and sulfur in an amount of 500 ppm or less, and is produced with yields of 40% or more based on the heavy feed oil. In this instance, the method may further include a third separation step of separating the heavy oil matter produced in the fifth hydrotreating step into a light oil matter and a heavy oil matter. The third separation step is selected from the group consisting of vacuum distillation, solvent deasphalting and thermal cracking. The light oil matter produced in the third separation step is used as the turbine fuel oil.

Thus, in the present invention, crude oil is subject to the atmospheric distillation, to thereby be separated into light oil or light distillate and atmospheric residue oil. The light oil is then hydrotreated and the atmospheric residue oil is subject to the separation treatment or hydrotreating, resulting in a light oil matter being produced. The light oil matter thus obtained is then subject to hydrotreating, to thereby provide refined oil, which is used as the gas turbine fuel oil. Thus, the present invention permits the gas turbine fuel oil to be produced with increased yields while ensuring high quality of the fuel oil.

In accordance with another object of the present invention, gas turbine fuel oil is provided, which is produced according to the method described above.

In addition, in accordance with a further aspect of the present invention, a power generation method is provided. The power generation method includes the steps of driving a gas turbine using gas turbine fuel oil produced as described above as fuel therefor to carry out power generation and using high-temperature exhaust gas discharged from the gas turbine as a heat source for a waste heat recovery boiler and driving a steam turbine by means of steam generated in the waste heat recovery boiler, resulting in power generation being carried out.

BEST MODE FOR CARRYING OUT THE INVENTION

Figure 1:
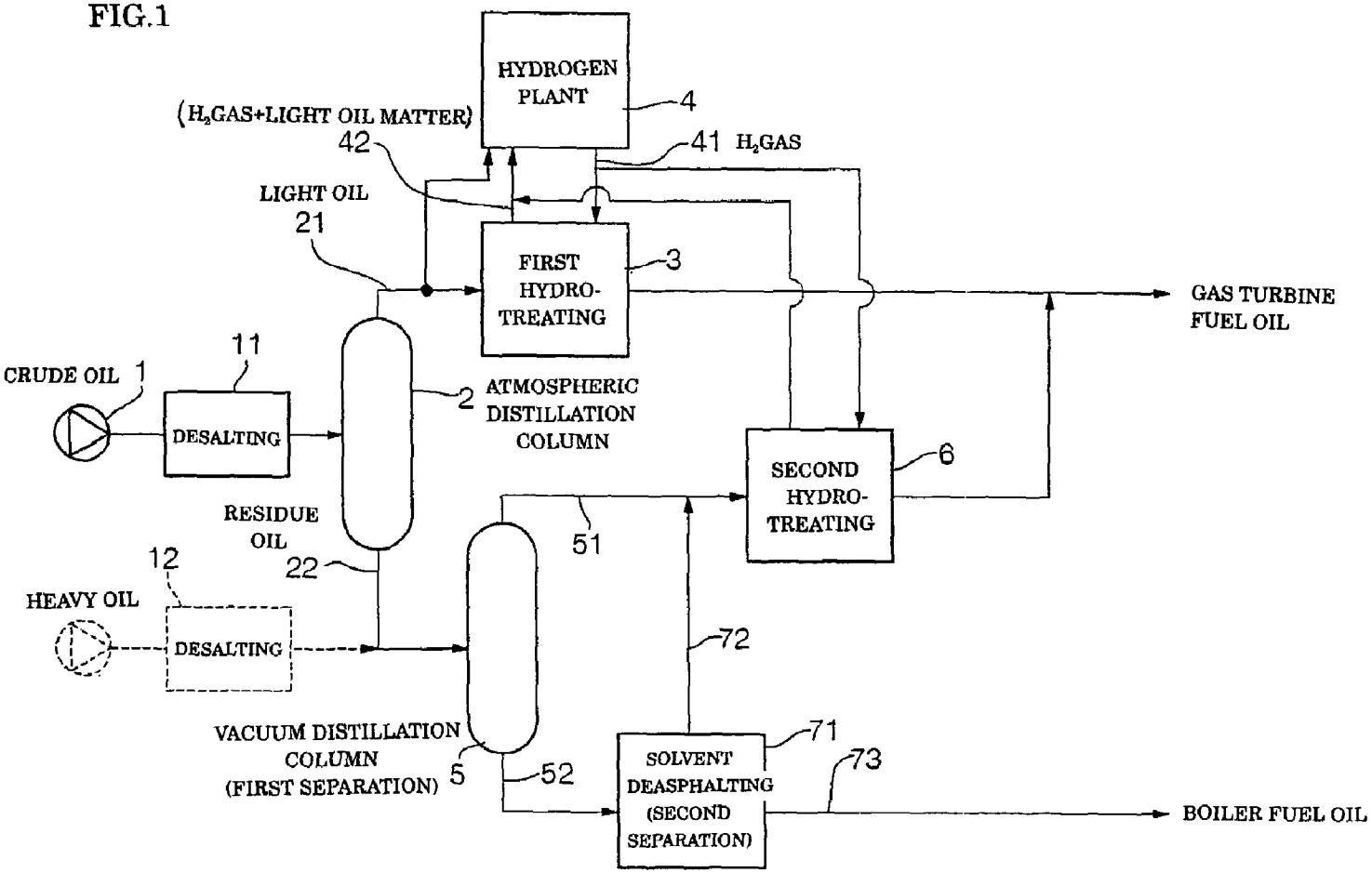
FIG. 1 is a schematic block diagram showing a system for executing a method for producing gas turbine fuel oil according to the present invention by way of example.

Referring first to FIG. 1, a system suitable for practicing a method for producing gas turbine fuel oil according to the present invention is illustrated by way of example. In each of embodiments described hereinafter, hydrotreating is executed. In the following description, first to fifth hydrotreating steps will be carried out depending on stages of the hydrotreating. Gas turbine fuel oils obtained in the hydrotreating steps are generally used while being mixed together. Thus, the following embodiments will be described in connection with mixed gas turbine fuel oil. Nevertheless, the present invention may be practiced without mixing the fuel oils, wherein the fuel oils are used separately from each other.

Feed oil 1 may be constituted by crude oil. The feed oil 1 is first subject to a desalting treatment in a desalting section 11 under such conditions as conventionally employed in petroleum refinery. The treatment is carried out in such a manner that feed oil and water are mixed together, to thereby transfer salt and a mud matter to an aqueous phase, resulting in alkaline metal which adversely affects a gas turbine being removed. The feed oil thus desalted is then fed to an atmospheric distillation column 2, resulting in being separated into, for example, light oil or light distillate 21 having a boiling point below 340 to 370° C. and residue oil (atmospheric residue oil) 22 higher than 340 to 370° C. in boiling point. The light oil 21 thus separated is then fed to a first hydrotreating unit 3.

Figure 2:
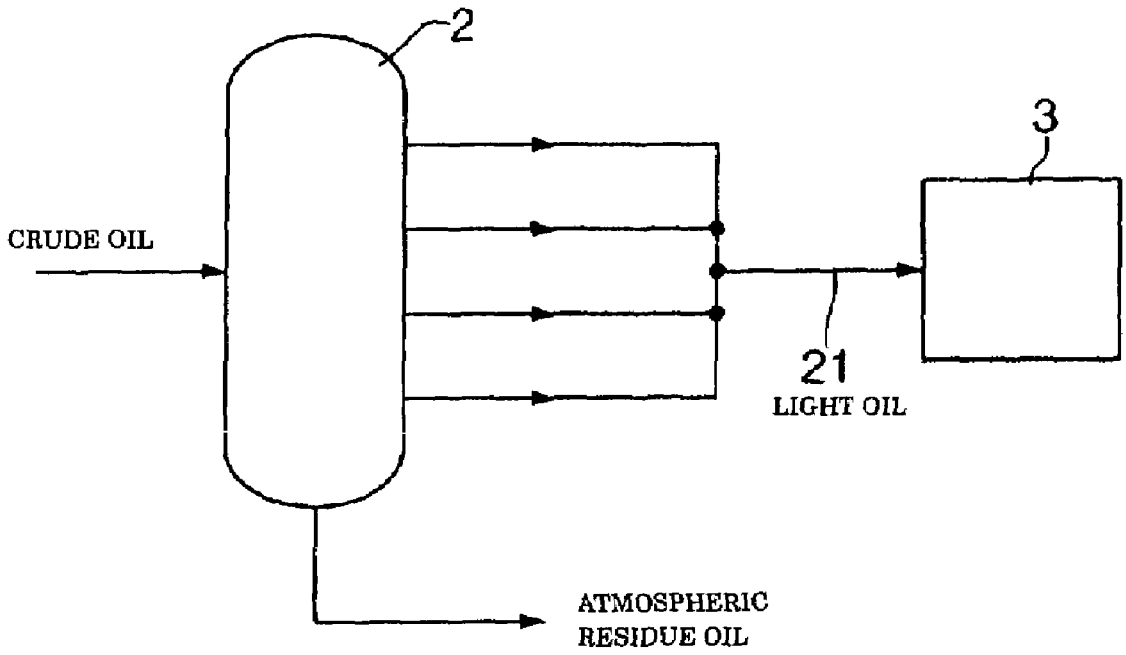
FIG. 2 is a schematic view showing another example of removal of light oil or light distillate from an atmospheric distillation column in the system shown in FIG. 1.

A conventional atmospheric distillation column 2 of a petroleum refinery is generally constructed in such a manner that a plurality of fraction takeoff ports are arranged so as to be distributed in order from a top of the atmospheric distillation column to a bottom thereof while positionally corresponding to boiling points of fractions such as kerosene, gasoline and the like, because light oil or light distillate contains fractions extending from a high boiling point to a low boiling point. This results in the fractions of the light oil being taken off from the takeoff ports as desired, respectively. On the contrary, the illustrated embodiment is constructed so as to permit the light oil or light distillate 21 to be taken off in a lump form, for example, a top of the atmospheric distillation column 2 while keeping fractions of the light oil mixed together, followed by feeding of the light oil to the hydrotreating unit 3. Alternatively, the illustrated embodiment, as shown in FIG. 2, may be so constructed that the fractions within the respective boiling point regions are taken off from a plurality of takeoff ports of the atmospheric distillation column 2 as in the prior art, respectively. Then, the fractions are mixed together, followed by feeding thereof to the hydrotreating unit 3, wherein the fractions are concurrently subject to hydrotreating. In FIG. 2, the atmospheric distillation column 2 is provided with four such takeoff ports.

More specifically, production of concurrent- or batch-desulfurization automobile fuel oil generally causes conditions for operation such as a temperature, a pressure, a catalyst and the like to be varied, because gasoline, kerosene and gas oil are different in desulfurization level from each other. On the contrary, in production of gas turbine fuel oil carried out by subjecting light oil or light distillate having a boiling point, for example, below 350° C. to concurrent desulfurization, it is merely required to conform operation conditions to specifications of gas turbine fuel oil as a whole, thus, the operation conditions are considerably different from those in a refinery. This permits light oil or light distillate produced in the atmospheric distillation column 2 to be concurrently subject to hydrotreating in a common unit, as described above.

The atmospheric distillation process produces light oil or light distillate containing a plurality of fractions different in boiling point from each other. The illustrated embodiment is aimed at gas turbine fuel oil, so that the fractions of the light oil may be treated in the hydrotreating unit concurrently or in a lump. Such concurrent treating permits a cost of equipment to be minimized. Hydrotreating techniques which may be applied to a system of the illustrated embodiment permit operation at a high temperature, because hue of gas turbine fuel oil is out of the question unlike a hydrotreating step carried out in a refinery for production of automobile fuel oil wherein operation takes place at a low temperature and a high pressure in order to avoid coloring of automobile fuel oil during the hydrotreating. This permits a reactor to be reduced in cost because it is operated at a low pressure, resulting in a further reduction in equipment cost.

Figure 3:
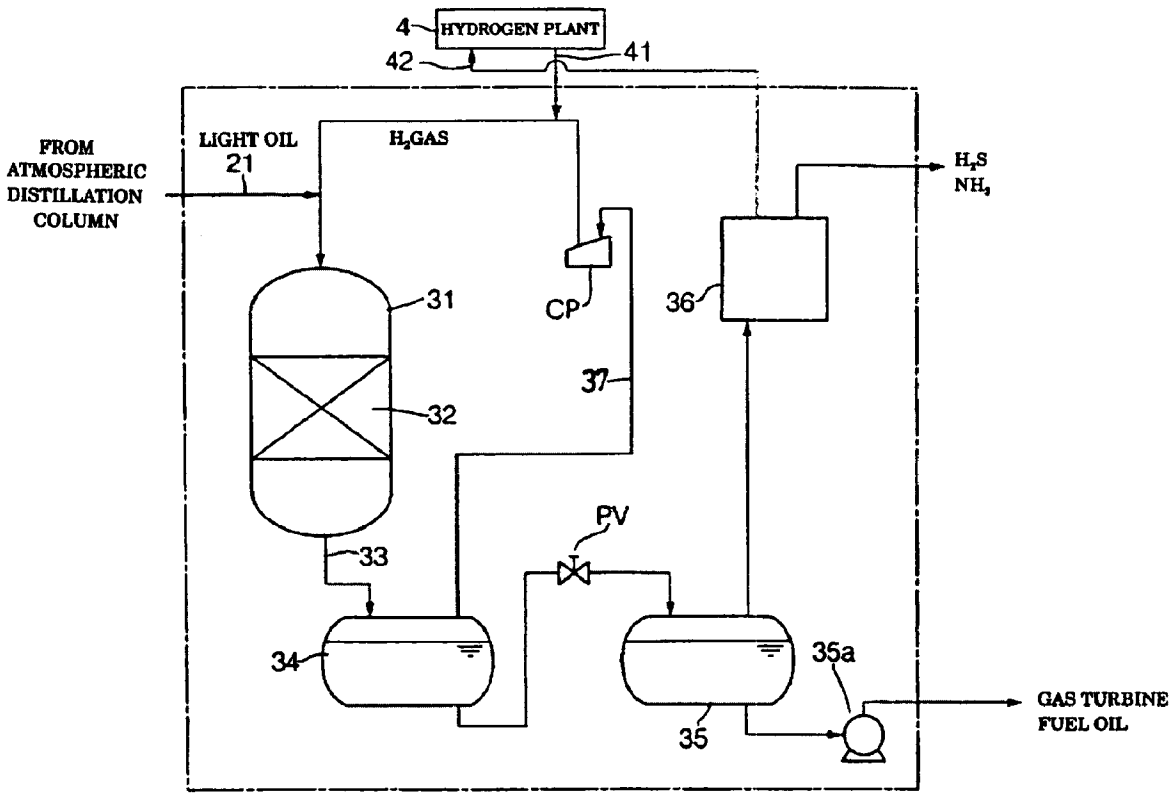
FIG. 3 is a schematic block diagram showing a hydrotreating unit by way of example.

Now, the hydrotreating unit 3 and hydrotreating carried out therein will be described with reference to FIG. 3. The light oil or light distillate 21 is mixed with pressurized hydrogen gas and then fed through a top of a reaction column 31 thereinto. The reaction column 31 is provided therein with a catalyst layer 32, which includes a carrier and a catalyst carried on the carrier. This results in the light oil or light distillate 21 and hydrogen gas passing through the catalyst layer 32 and then being fed from a bottom of the reaction column 31 through a liquid feed pipe 33 into a high-pressure tank 34. A slight amount of heavy metals such as vanadium, nickel, lead and the like which are included in the light oil 21 or kept entering hydrocarbon molecules, as well as sulfur and nitrogen are reacted with hydrogen during a period of time for which they pass through the catalyst layer 32, to thereby be detached or removed from the hydrocarbon molecules. This results in the heavy metals being adsorbed onto a surface of the catalyst and the sulfur and nitrogen being reacted with the hydrogen to form hydrogen sulfide and ammonia, respectively. Alkaline metals which are dissolved in water slightly contained in an oil matter or present in the form of salts are adsorbed onto the surface of the catalyst. Metals are generally contained in heavy oil or residue, resulting in being present in a trace amount in the light oil 21.

From the bottom of the reaction column 31 is discharged mixed fluid of oil and high-pressure gas at a pressure as high as 30 to 80 kg/cm$^2$, which is then fed to the high-pressure tank 34, wherein hydrogen gas is separated from the mixture. The hydrogen gas is increased in pressure by means of a compressor CP and then circulatedly fed into the reaction column 31. A liquid matter separated from the hydrogen in the high-pressure tank 34 is fed through a pressure regulator PV to a low-pressure tank 35, resulting in being reduced in pressure by, for example, about 10 to 30%. This results in liquefied gas such as hydrogen sulfide, ammonia and the like dissolved in the liquid matter or oil being vaporized. Refined oil which is the liquid thus separated constitutes gas turbine fuel oil. Reference character 35*a* designates a pump. Gas separated in the low-pressure tank 35 contains unreacted hydrogen gas and hydrogenated compounds such as hydrogen sulfide, ammonia and the like, as well as methane produced by cutting of a part of hydrocarbon molecules and a light oil matter extending from a liquefied petroleum gas fraction to light naphtha. The term "light oil matter" used herein indicates an ingredient lighter than the light oil or light distillate 21. Gas separated in the tank 35 is fed to an impurity removal section 36, wherein hydrogen sulfide and ammonia contained in the gas is removed therefrom.

The impurity removal section 36 may be provided therein with an absorption liquid layer for absorbing impurities such as, for example, hydrogen sulfide and ammonia, so that passing of the gas through the absorption liquid layer permits the impurities to be removed from the gas. The gas from which the impurities are thus removed contains a mixed gas 42 of unreacted hydrogen gas and a light oil matter decreased in the number of carbon atoms such as methane and the like. The mixed gas 42 is fed to a hydrogen plant 4, wherein the light oil matter in the mixed gas 42 is used as a material for production of hydrogen gas. A part of the light oil 21 separated in the atmospheric distillation column 2 as well is fed to the hydrogen plant 4, to thereby be used as a material for production of hydrogen gas. When feed oil for production of hydrogen gas is limited to heavy oil, naphtha may be externally introduced into the hydrogen plant 4 only at the time of starting of the plant 4.

Hydrogen gas fed to the reaction column 31, as described above, is circulatedly used, during which hydrogen gas contained in gas in a circulation path 37 is gradually decreased, whereas a light oil matter such as methane and the like is gradually increased. This results in hydrogen gas being relatively reduced. In order to avoid such a situation, hydrogen gas 41 is supplied from the hydrogen plant 4 to the circulation path 37, to thereby ensure the hydrotreating.

Figure 4:
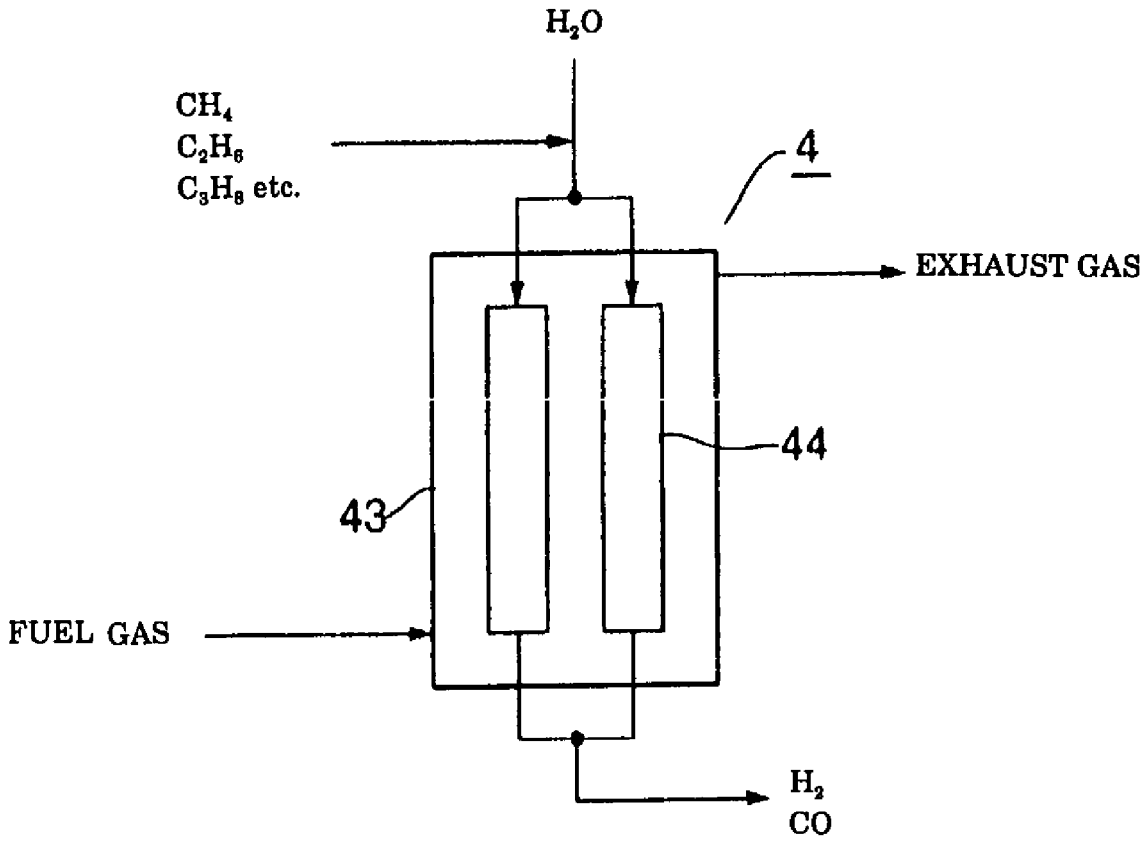
FIG. 4 is a schematic view showing an essential part of a hydrogen plant by way of example.
Figure 5:
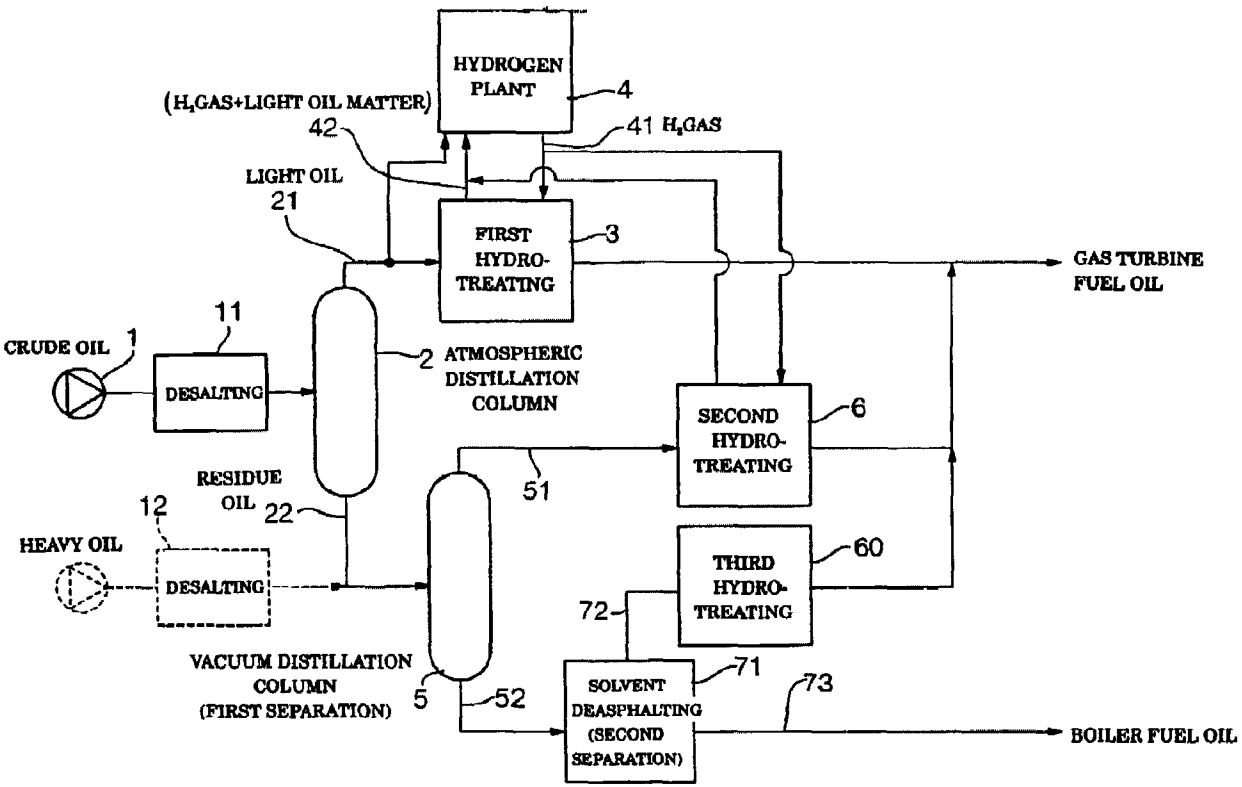
FIG. 5 is a schematic block diagram showing another example of a system for practicing a method according to the present invention.

The hydrogen plant 4 may be constructed in such a manner as shown in FIG. 4. The hydrogen plant 4 includes a combustion furnace 43 in which fuel gas is burned, as well as reaction pipes 44 arranged in the combustion furnace 44. A light oil matter such as methane and steam are introduced into the reaction pipes 44, so that the light oil matter is subject to steam reforming, to thereby carry out production of hydrogen and by-production of carbon monoxide. Then, carbon monoxide and an unreacted light oil matter are modified or removed from the gas, to thereby obtain hydrogen gas. The removal treatment or refining may be carried out, for example, by pressure swing adsorption (PSA), temperature swing adsorption (TSA), low temperature separation, film separation or the like.

First to fifth hydrogenating steps in the present invention each may contact the light oil or light oil matter with pressurized hydrogen in the presence of a catalyst, to thereby carry out any of (1) hydrodesulfurization or hydrotreating for desulfurization for removal of impurities such as a sulfur compound and the like, (2) hydrorefining for an improvement in properties of the light oil or light oil matter due to saturation of unsaturated hydrocarbons or the like and (3) hydrocracking for transformation of the oil or oil matter into a lighter oil matter. A main object of the first hydrotreating step is to attain the desulfurization (1) described above, and that of each of the second and third hydrotreating steps is to accomplish the desulfurization (1) and hydrorefining (2) described above, and that of each of the fourth and fifth hydrotreating steps is to carry out the desulfurization (1), hydrorefining (2) and hydrocracking (3) described above.

Now, a process carried out in the first hydrotreating unit 3 will be described. Conventional petroleum refining is separately applied to naphtha, kerosene, gas oil and the like contained in the light oil or light distillate and subjects each of fractions of a narrow boiling point range to hydrotreating. On the contrary, the present invention subjects all fractions distilled by the atmospheric distillation to hydrotreating concurrently or in a lump. Thus, the present invention permits the amount of material hydrotreated to be substantially increased as compared with the prior art. Hydrotreating conditions such as a hydrogen gas pressure, a reaction temperature and the like may be varied depending on the type of oil to be hydrotreated, an object of the hydrotreating and the like. More specifically, the temperature and hydrogen gas pressure may be selected within a range of 330 to 380° C. and a range of 20 to 80 kg/cm$^2$, respectively. In particular, the hydrogen gas pressure is preferably set to be within a range of 30 to 70 kg/cm$^2$. Also, the catalyst may be selected from those for hydrotreating conventionally known in the art. The catalyst is preferably formed by carrying sulfide of Ni, Mo or Co on alumina. When Arabian light oil is to be treated, the hydrogen gas pressure may be set within a range between 30 kg/cm$^2$ and 50 kg/cm$^2$, resulting in gas turbine fuel oil being provided which has a sulfur concentration of 450 ppm or less and a nitrogen concentration of 30 ppm or less. In this instance, an increase in hydrogen gas pressure to 40 to 70 kg/cm$^2$ permits an increase in collision energy of hydrogen against molecules of the oil ingredient, so that the sulfur concentration and nitrogen concentration may be reduced to 200 ppm or less and 20 ppm or less, respectively.

The residue oil (atmospheric residue oil) 22 separated in the atmospheric distillation column 2 is fed to a vacuum distillation column 5, wherein the residue oil is separated into a light oil matter (vacuum light oil matter) 51 of 565° C. in atmospheric boiling point which is the lightest fraction in the residue oil 22 and a heavy oil matter or residue (vacuum residue oil) 52 having an atmospheric boiling point above 565° C. The light oil matter 51 is fed to a second hydrotreating unit 6, to thereby be subject to hydrotreating.

Hydrogen gas used in the second hydrotreating is fed from the above-described hydrogen plant 4 thereto. Gas decreased in number of carbon atoms such as methane or the like which is produced in the second hydrotreating unit 6 is fed in the form of a feed material to the hydrogen plant 4. When the Arabian light oil described above is used as feed oil, setting of a hydrogen gas pressure at 30 to 60 kg/cm$^2$ in the second hydrotreating unit 6 permits the sulfur concentration and nitrogen concentration to be as low as 2000 ppm or less and 200 ppm or less, respectively. Also, a hydrogen gas pressure of 50 to 100 kg/cm$^2$ reduces the sulfur concentration and nitrogen concentration to a level of 1000 ppm or less and that of 100 ppm or less, respectively.

The light oil matter thus produced in the second hydrotreating unit 6 is mixed with the light oil matter (gas turbine fuel oil) produced in the first hydrotreating unit 3 (mixing step), to thereby be used as gas turbine fuel oil.

The heavy oil matter (vacuum residue oil) 52 separated in the vacuum distillation column 5 is separated into a light oil matter or deasphalted oil 72 and a heavy oil matter or deasphalted residue oil 73 in a solvent deasphalting unit or solvent extraction unit 71. The separation is carried out by feeding the vacuum residue oil 52 and a solvent from a top of the column and a bottom thereof to the unit 71 to subject both to counterflow contact, respectively, resulting in the light and heavy oil matters in the vacuum residue oil matter 52 being separated from each other due to a different in solubility in the solvent.

The deasphalted oil 72 thus separated is mixed with the light oil matter 51 from the vacuum distillation column 5 and then fed to the second hydrotreating unit 6. The deasphalted residue oil 73 is subject to viscosity adjustment as required and then used as heavy feed oil or fuel oil for a boiler.

Thus, the hydrotreating carried out in the first hydrotreating unit 3 and that in the second hydrotreating unit 6 correspond to the first hydrotreating step and second hydrotreating step, respectively, and the vacuum distillation carried out in the vacuum distillation column 5 and the treatment in the solvent deasphalted unit 71 correspond to first and second separation steps, respectively.

The illustrated embodiment permits the gas turbine fuel oil which meets composition requirements defined in "DISCLOSURE OF THE INVENTION" herein to be provided. In the illustrated embodiment, the atmospheric distillation step and vacuum distillation step each are followed by the hydrotreating step, so that each of the distillation steps may be carried out while paying no regard to the amount of sulfur and heavy metal, leading to an increase in amount of the light oil matter. Thus, when crude oil is used as the feed oil, the gas turbine oil may be produced at yields as high as 65% or more and preferably 70 to 90% (weight ratio) based on the crude oil. Also, when heavy feed oil consisting of atmospheric distillation residue and/or heavy oil is the starting feed oil, the gas turbine fuel oil may be produced with yields as high as 40% or more and preferably 40 to 75% (weight ratio) based on the heavy feed oil.

More specifically, supposing that crude oil is fed in a relative amount of 100 to the atmospheric distillation column 2, light oil and atmospheric residue are distilled at a ratio of 60:40 therein. A light oil matter and vacuum residue may be distilled at a ratio of 40:20 based on the atmospheric residue in a relative amount of 40. Further, the vacuum residue oil in a relative amount of 20 may be treated in the solvent deasphalting unit 71, resulting in deasphalted oil and deasphalted residue being produced at a relative ratio of 10:10. When crude oil is used as the starting feed oil, gas turbine fuel oil may be produced which contains a light oil matter, a vacuum light oil matter and deasphalted oil at a relative ratio of 60:20:10, resulting in the yields being 90%. The yields are as high as 80% even when the deasphalting treatment is executed. Thus, the present invention, when crude oil is used as the starting feed oil, provides gas turbine fuel oil at yields 65% or more and preferably 70 to 90% depending on the type of feed oil.

In addition, heavy feed oil consisting of atmospheric residue oil and/or heavy oil is used in a relative amount of 100 as the starting feed oil, a light oil matter and vacuum residue may be distilled at a relative ratio of 50:50 in the vacuum distillation column 5. The vacuum residue in a relative amount of 50 permits deasphalted oil and deasphalted residue oil to be produced at a relative ratio of 25:25 in the solvent deasphalting unit 71. Thus, when the heavy feed oil is used as the starting oil, gas turbine fuel oil consisting of a vacuum light oil matter and solvent deasphalted oil at a relative amount of 50:25 may be obtained, resulting in the yields being 75%. The yields are kept at a level as high as 50% even when the deasphalting treatment does not take place. In FIG. 1, dotted lines indicate that heavy oil is subject to the desalting treatment and then fed to the vacuum distillation column 5. The present invention, when the above-described heavy feed oil is used as the starting oil in view of a variation due to a difference in type of feed oil, permits gas turbine fuel oil to be produced with yields of 40% or more and preferably 40 to 75%.

The present invention is constructed so as to carry out hydrotreating on light oil or light distillate after the distillation step rather than direct hydrotreating of crude oil, so that it is merely required to determine the reaction conditions in conformity to the light oil. Thus, an increase in reaction pressure and temperature may be minimized and the reaction time may be reduced, leading to simplification of the system. Also, the present invention is directed to gas turbine fuel oil, resulting in the fractions produced in the distillation step being hydrotreated concurrently or in a lump, leading to simplification of the process.

In the present invention, heavy oil may be fed to the vacuum distillation column 5 as indicated at the dotted lines in FIG. 1. Alternatively, heavy oil may be fed to the solvent deasphalting unit 71. Such feeding does not affect a series of steps started by feeding the crude oil to the atmospheric distillation column 2. Thus, this does not affect yields of the gas turbine fuel oil produced from the crude oil. The gas turbine fuel oil is simply increased with an increase in additional feed oil, thus, it is within the scope of the present invention.

In addition, the present invention is not limited to the construction that the light oil matter produced in the second separation step or the deasphalted oil 72 produced in the solvent deasphalting unit 71 is treated in the second hydrotreating unit 6. Thus, it may be treated in a third hydrotreating step or a third hydrotreating unit 60 arranged separately from the second hydrotreating unit 6. Common practicing of the second and third hydrotreating steps as in the embodiment shown in FIG. 1 requires to determine reaction conditions in conformity to the heavy oil matter, resulting in the hydrogen gas pressure being at a level as high as, for example, 50 to 150 kg/cm$^2$. On the contrary, practicing of the steps in a manner to be separate from each other results in the hydrogen gas pressure in the second and third steps being 50 to 150 kg/cm$^2$ and 80 to 200 kg/cm$^2$, respectively. Thus, the separate practicing permits the amount of material treated in the third hydrotreating step to be significantly reduced, so that a pressure-resistant reaction vessel may be reduced in size. In any event, the system may be constructed advantageously depending on a scale thereof and the like, as desired.

In the present invention, in practicing of the first to third hydrotreating steps, the first and third steps may be commonly or concurrently carried out. Alternatively, the first to third steps may be commonly carried out.

Figure 6:
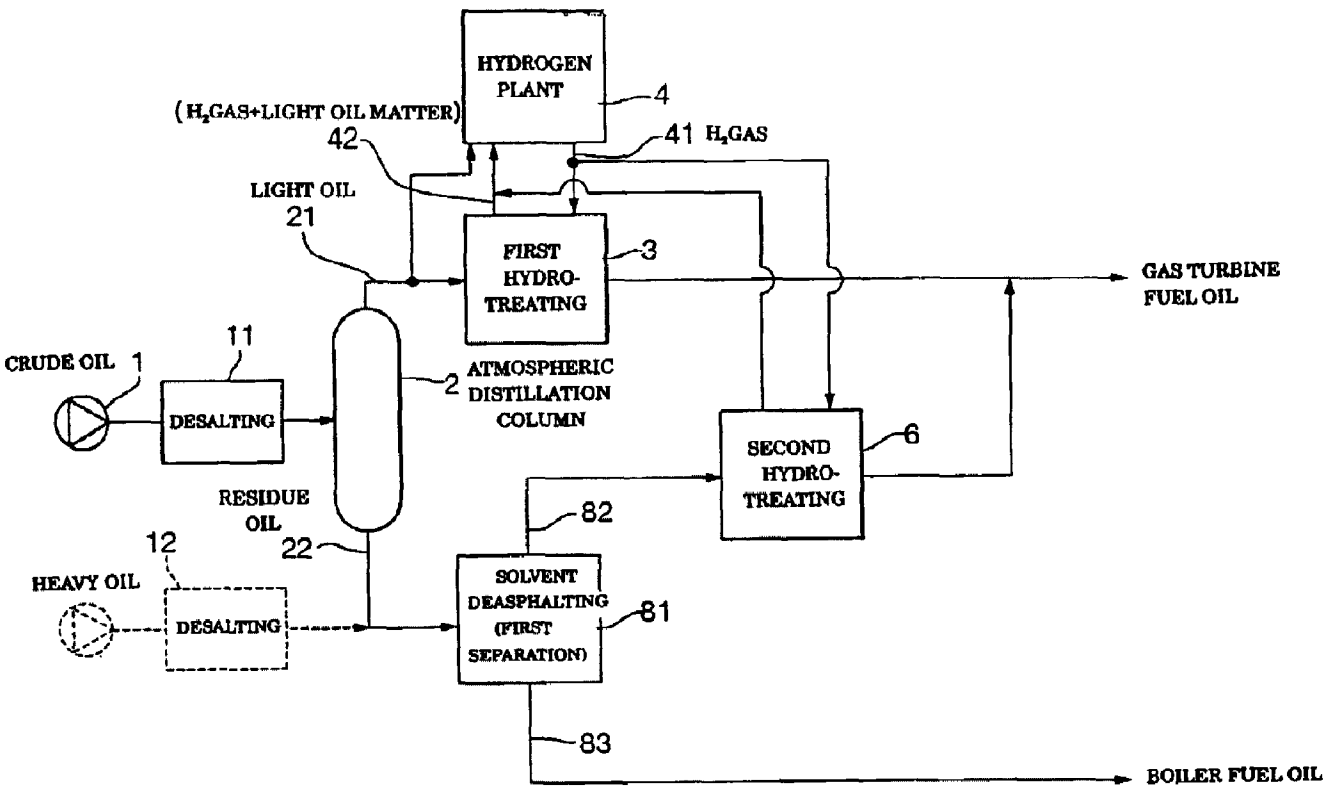
FIG. 6 is a schematic block diagram showing a further example of a system for practicing a method according to the present invention.

In the present invention, the first separation step for subjecting the residue oil 22 produced in the atmospheric distillation unit 2 to the separation treatment is not limited to vacuum distillation. It may be executed by steam distillation, solvent deasphalting, thermal cracking for heating the residue oil 22 to a temperature of, for example, 430 to 490° C. to cut hydrocarbon molecules by means of thermal energy, to thereby produce a light oil matter and a heavy oil matter, or the like. Execution of the first separation step by solvent deasphalting may be carried out in such a manner as shown in FIG. 6, which illustrates another embodiment of the present invention. Atmospheric residue oil 22 is fed to a solvent deasphalting unit 81, resulting in being separated into a light oil matter (solvent deasphalted oil) 82 and a heavy oil matter (solvent deasphalted residue oil) 83. The light oil matter 82 is fed to the second hydrotreating unit 6.

In the embodiment shown in FIG. 6, a second separation step is not carried out. However, the solvent deasphalted residue oil 83 may be subject to the second separation step as in the embodiment shown in FIG. 1. The second separation step may be practiced by such thermal cracking as described above.

Figure 7:
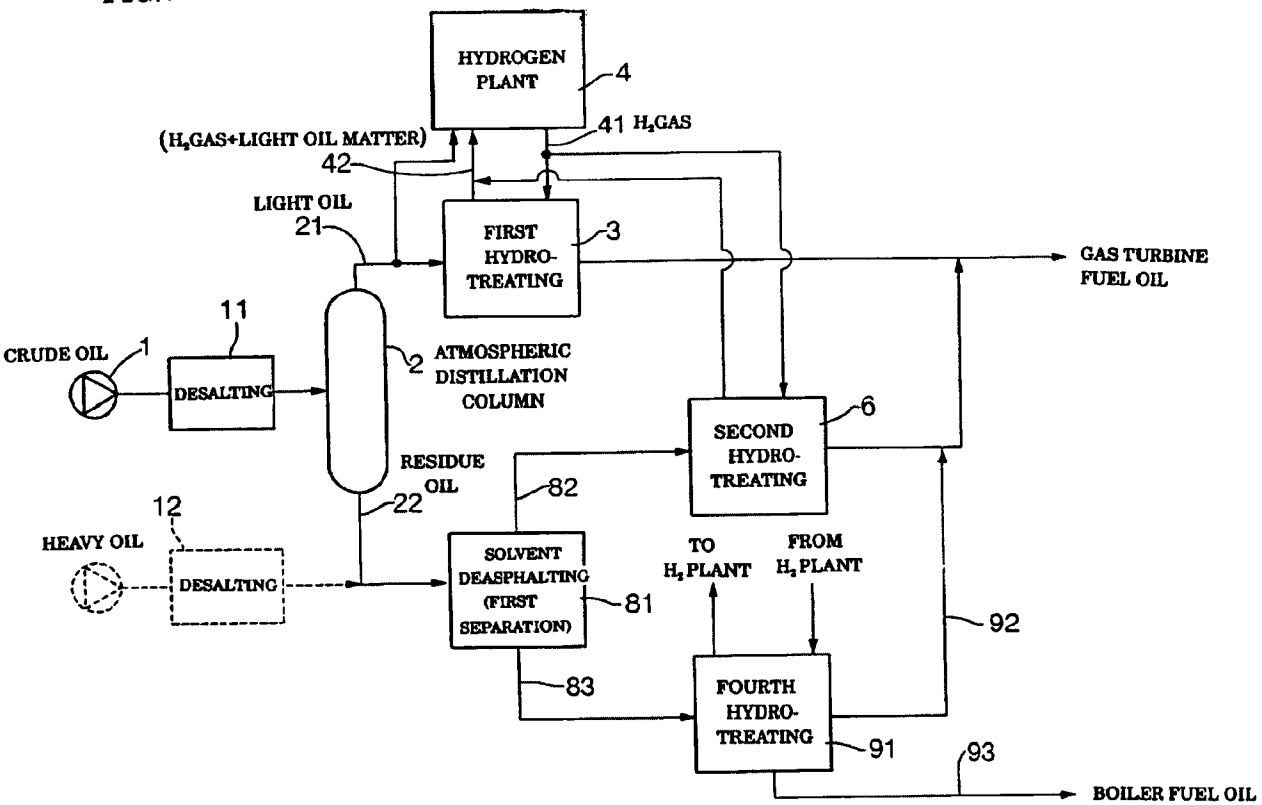
FIG. 7 is a schematic block diagram showing still another example of a system for practicing a method according to the present invention.

The heavy oil matter separated in the first separation step may be subject to hydrotreating as shown in FIG. 7, which shows a further embodiment of the present invention. More particularly, a heavy oil matter (deasphalted residue oil) 83 separated in a solvent deasphalted unit 81 is fed to a fourth hydrotreating unit 91, to thereby be separated into a light oil matter 92 and a heavy oil matter 93. The fourth hydrotreating unit 91 is arranged at a rear stage of the unit shown in FIG. 3 and includes a distillation unit for separating the heavy oil matter 83 into the light oil matter 92 and heavy oil matter 93 such as, for example, an atmospheric distillation unit or a vacuum distillation unit.

The embodiments thus constructed each permit gas turbine fuel oil to be obtained from the heavy oil matter separated in the first separation step (for example, the solvent deasphalting step) as well, resulting in recovery of the gas turbine fuel oil being significantly increased. Alternatively, a part of the feed oil may be fed to the fourth hydrotreating unit 91 while being mixed with the heavy oil matter 83 separated in the solvent deasphalting unit 81.

Figure 8:
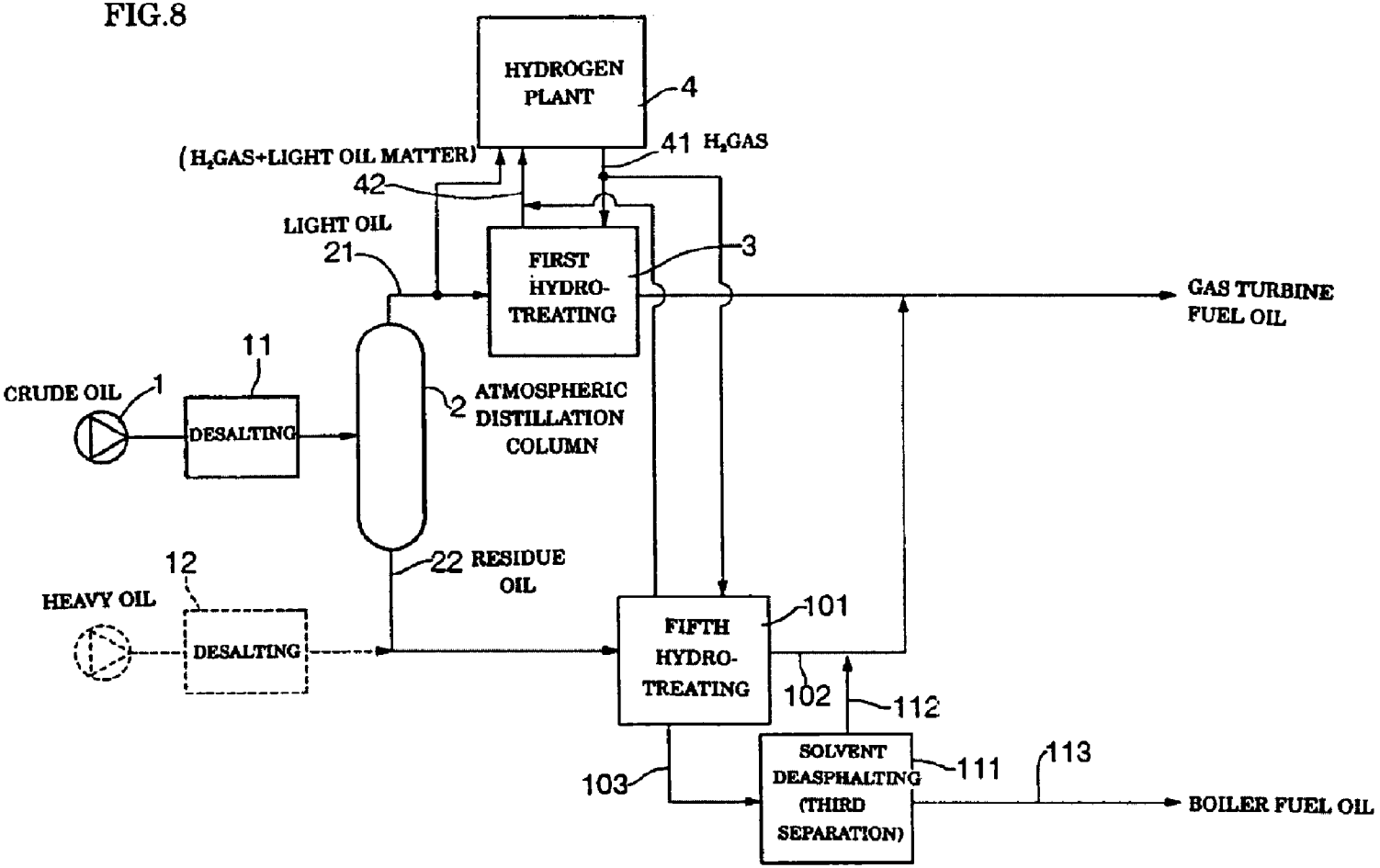
FIG. 8 is a schematic block diagram showing yet another example of a system for practicing a method according to the present invention.

Also, the present invention may be constructed in such a manner as shown in FIG. 8, which illustrates still another embodiment of the present invention. In the illustrated embodiment, residue oil 22 separated in an atmospheric distillation step is fed to a fifth hydrotreating unit 101, wherein a fifth hydrotreating step is carried out to separate the residue 22 into a light oil matter 102 and a heavy oil matter 103, so that the light oil matter 102 may be mixed with gas turbine fuel oil produced in a first hydrotreating unit 3. The fifth hydrotreating unit 101 includes a distillation unit as in the fourth hydrotreating unit 91.

The heavy oil matter 103 is fed to a solvent deasphalting unit 111, to thereby be separated into a light oil matter (deasphalted oil) 112 and a heavy oil matter (deasphalted residue oil) 113. The light oil matter 112 thus separated is used as gas turbine fuel oil while being mixed with, for example, the light oil matter 102 produced in the fifth hydrotreating unit 101, and the heavy oil matter 113 is used as, for example, fuel oil for a boiler. A third separation step is not limited to a solvent deasphalting step and may be executed in the form of a thermal cracking step or a vacuum distillation step. The illustrated embodiment likewise permits recovery of gas turbine fuel oil from feed oil to be as high as 65% or more and preferably 70 to 90%. The light oil matter (gas) such as methane or the like produced in each of the fourth hydrotreating unit 91 and fifth hydrotreating unit 101 shown in FIGS. 7 and 8 is fed to a hydrogen plant 4 for production of hydrogen gas.

Figure 9:
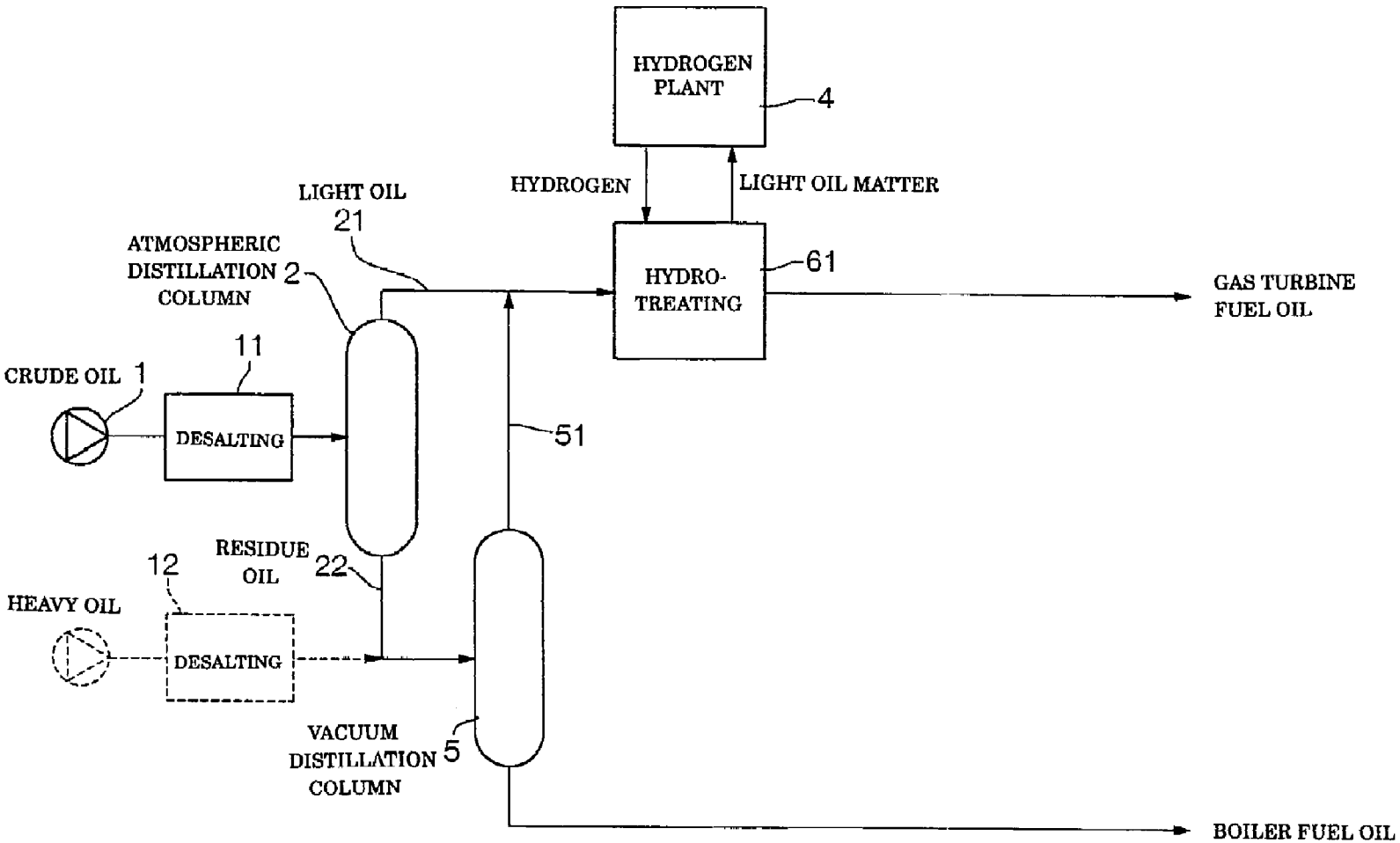
FIG. 9 is a schematic block diagram showing even another example of a system for practicing a method according to the present invention.

In the embodiments described above, the light oil or light distillate 21 produced in the atmospheric distillation column 2 and the light oil matter (vacuum light oil matter) 51 produced in the vacuum distillation column 5 are treated in the hydrotreating units different from each other, respectively. Alternatively, the present invention may be constructed as shown in FIG. 9, which illustrates yet another embodiment of the present invention. In the illustrated embodiment, light oil 21 and a light oil matter 51 are mixed with each other and then subject to hydrotreating in a hydrotreating unit 6. Such construction corresponds to a combination of the first hydrotreating unit 3 and second hydrotreating unit 6 in the embodiment shown in FIG. 1. In general, reaction conditions for hydrotreating are determined in conformity to a heavy oil matter contained in feed oil. In the illustrated embodiment, the heavy oil matter corresponds to the light oil matter (vacuum light oil matter) 51. Thus, the light oil matter 21 and vacuum light oil matter 51 are treated in a lump while reducing a weight ratio (volume ratio) of the light oil matter 21 to the vacuum light oil matter 51 in the feed oil. Such a treatment eliminates arrangement of a unit for hydrotreating the light oil matter, leading to a reduction in manufacturing cost. An increase in ratio of the light oil matter 21 or a decrease in ratio of the vacuum light oil matter 51 requires that the reaction conditions are set in conformity to a heavy oil matter corresponding to the vacuum light oil matter 51 in a small amount. This renders reactor design difficult or troublesome, resulting in failing to satisfactorily exhibit an economic advantage. On the contrary, setting of the reaction conditions in conformity to the vacuum light oil matter 51 contributes to a significant improvement in refining of the light oil matter.

In the embodiment shown in FIG. 9, the first separation step is executed in the form of vacuum distillation by way of example. However, the first separation step may be constituted by any other suitable techniques. A light oil matter produced by the techniques and the light oil 21 may be treated in a hydrotreating unit 61 concurrently or in a lump.

When a process in the hydrotreating unit 61 is carried out using Arabian light oil, setting of a hydrogen gas pressure within a range of 30 to 60 kg/cm$^2$ permits sulfur and nitrogen concentrations in gas turbine fuel oil to be as low as 500 ppm or less and 50 ppm or less, respectively. An increase in hydrogen gas pressure to a level of 50 to 100 kg/cm$^2$ permits the sulfur and nitrogen concentrations to be further reduced to levels as low as 300 ppm or less and 30 ppm or less, respectively.

Figure 10:
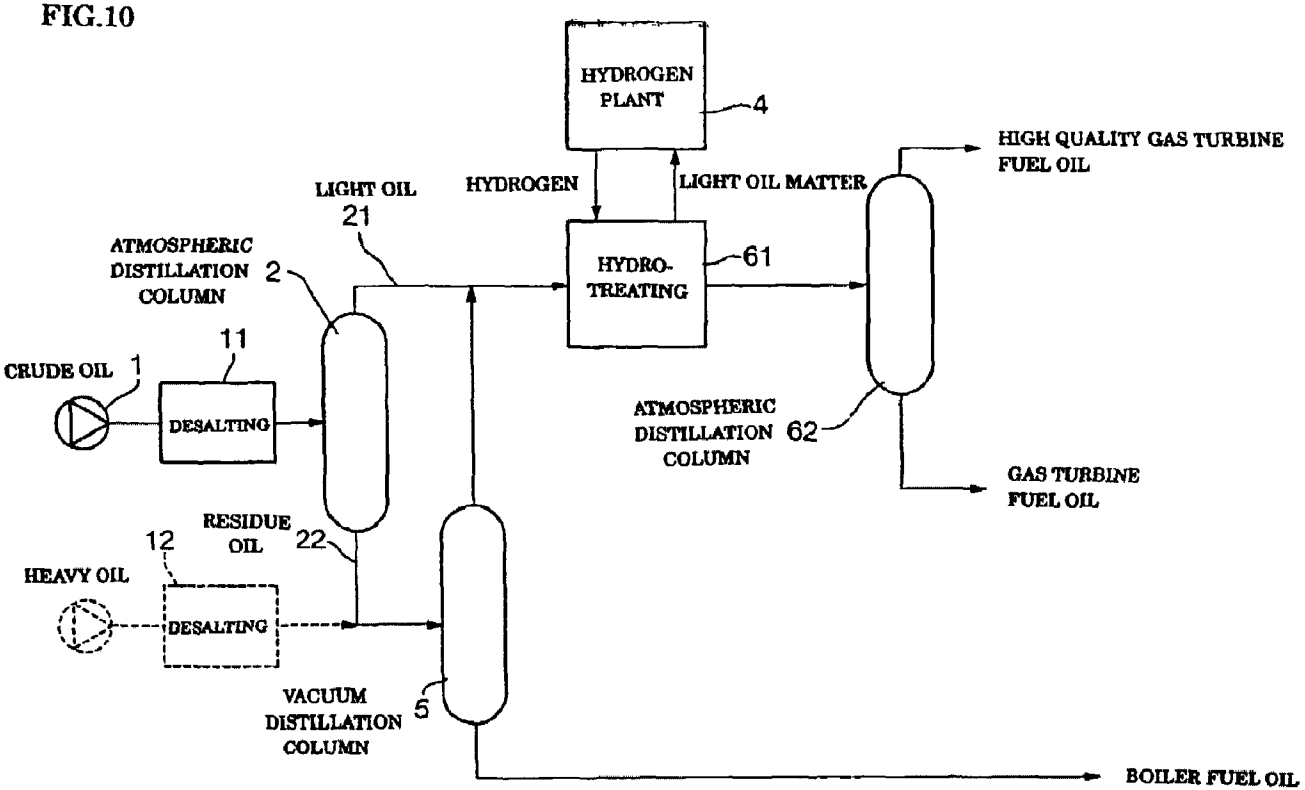
FIG. 10 is a schematic block diagram showing a still further example of a system for practicing a method according to the present invention.

Refined oil produced by concurrent treating of the light oil matter and light oil 21 in the hydrotreating unit 61 is sufficient for use as gas turbine fuel oil. Alternatively, the refined oil, as shown in FIG. 10, is subject to distillation at a temperature of, for example, 350° C. in an atmospheric distillation column 62, so that the resultant light oil matter may be used as gas turbine fuel oil increased in quality and the resultant residue oil may be used as gas turbine fuel oil heavier than the light oil matter.

Figure 11:
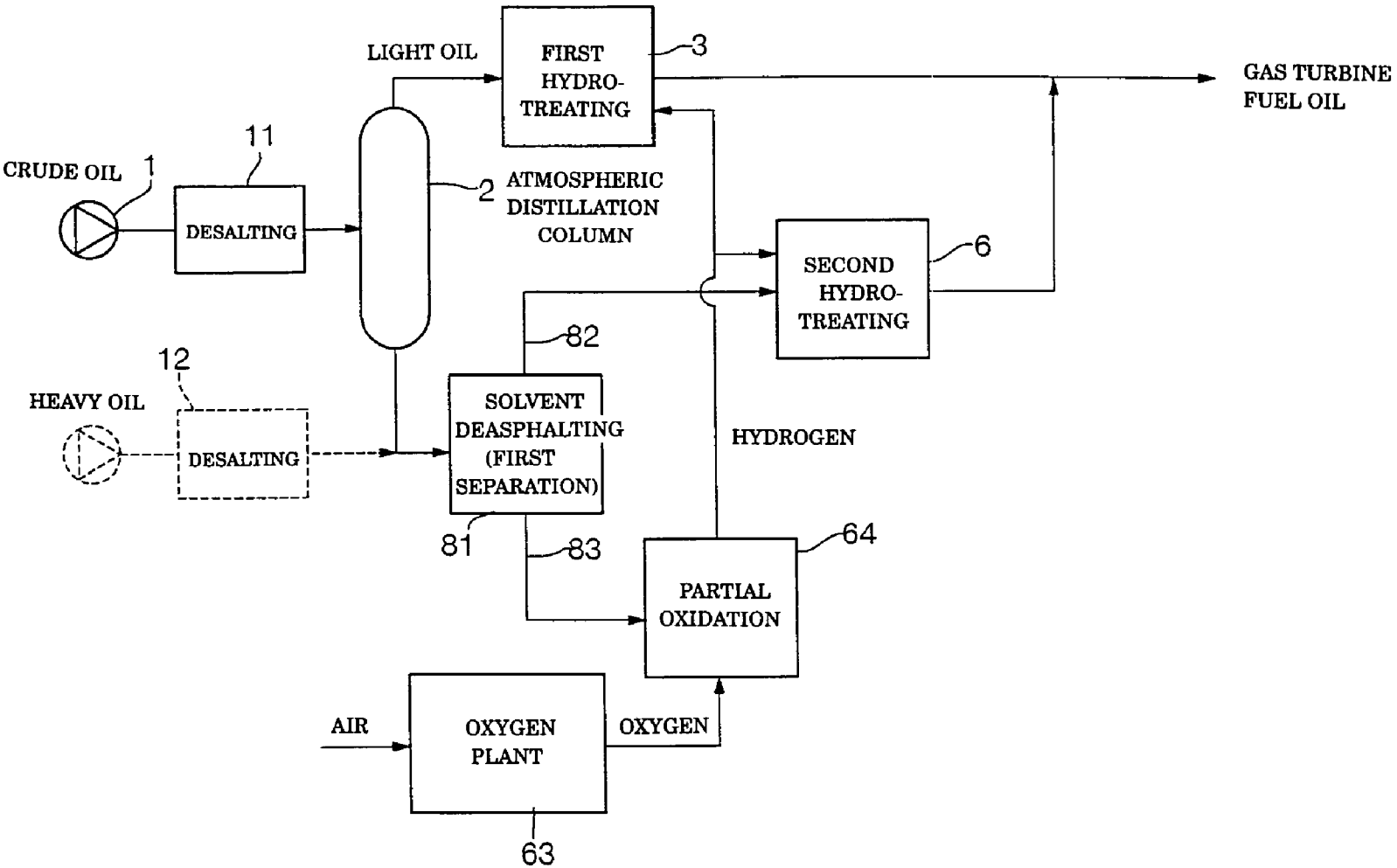
FIG. 11 is a schematic block diagram showing a yet further example of a system for practicing a method according to the present invention.

The present invention may be so constructed that the heavy oil matter produced in the first separation step, second separation step and/or third separation step is partially oxidized by means of oxygen gas to produce hydrogen, which is then used in a hydrotreating unit. The hydrotreating unit may be that used in any one of the first to fourth hydrotreating steps. FIG. 11 illustrates a still further embodiment of the present invention which is constructed so as to carry out such hydrotreating. More specifically, residue oil fed from a solvent deasphalting unit 81 is subject to partial oxidation to produce hydrogen, which is then fed to a first hydrotreating unit 3 and a second hydrotreating unit 6. Reference numeral 63 designates an oxygen plant for removing oxygen from air and 64 is a partial oxidation unit. A heavy oil matter to be partially oxidized is not limited to residue oil produced in the solvent deasphalting unit 81, thus, any residue oil produced in a first separation step in a vacuum distillation column 5 or the like may be partially oxidized. Alternatively, a heavy oil matter obtained in a second or third separation step may be used for this purpose.

Figure 12:
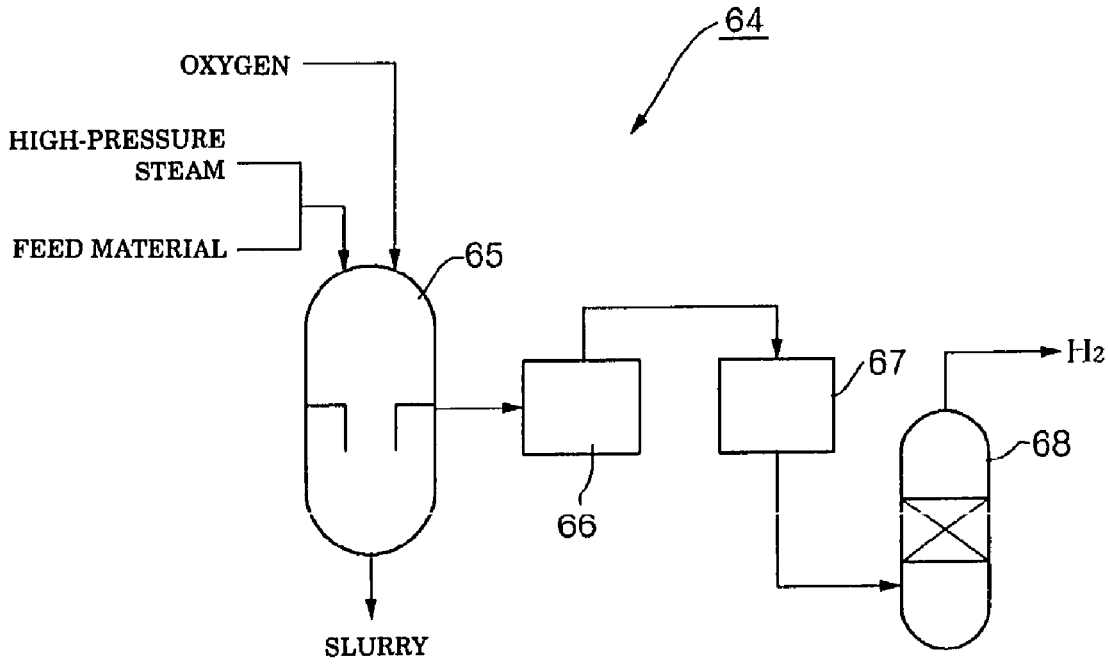
FIG. 12 is a schematic view showing a partial oxidation unit incorporated in the system shown in FIG. 10 by way of example.

The partial oxidation unit 64 may be constructed as shown in FIG. 12. In the unit 64 of FIG. 12, a heavy oil matter and high-pressure steam are previously heated and then injected into a reaction furnace 65 together with oxygen, so that gas mainly consisting of CO and $H_2$ may be produced by a partial oxidation reaction under process conditions of, for example, 1200 to 1500° C. in temperature and 2 to 85 kg/cm$^2$ in pressure. Then, the gas is quenched or quickly cooled to 200 to 260° C. by means of water in a quenching chamber arranged under the reaction furnace 65. This permits a large part of unreacted carbon to be removed and steam required for the subsequent CO conversion process to be introduced into the gas. The gas is then fed to a scrubbing tower 66, wherein any remaining unreacted carbon may be fully removed from the gas. Then, it is fed to a CO converter 67, wherein CO remaining in the gas is converted into CO2 through a reaction of CO with steam by means of, for example, a cobalt-molybdenum catalyst. Subsequently, oxidizing gas such as CO2 and the like is absorbed in an acidic gas absorption tower 68, resulting in hydrogen gas highly increased in purity being obtained.

Figure 13:
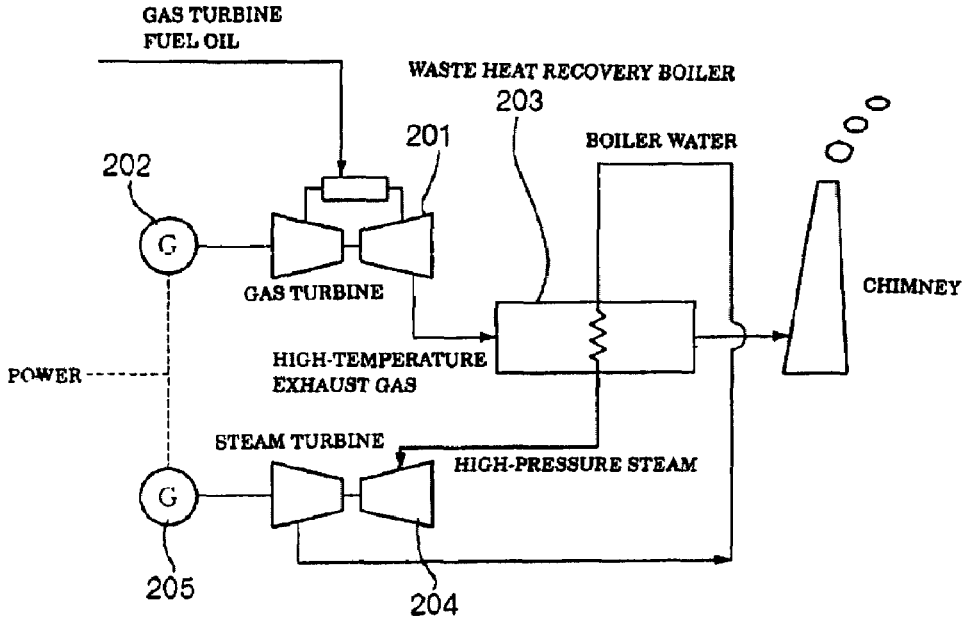
FIG. 13 is a diagrammatic view showing the manner of use of gas turbine fuel oil produced by the present invention by way of example.

The gas turbine fuel oil thus provided by the present invention may be utilized for, for example, power generation, as shown in FIG. 13. More particularly, the gas turbine fuel oil is burned at a combustion nozzle, resulting in combustion gas being produced, which is then used for driving a gas turbine 201, so that a generator 202 generates electric power. The gas turbine 201 discharges high-temperature exhaust gas, which is fed to a waste heat recover boiler 203, which generates steam using heat of the exhaust gas. The steam permits driving of a steam turbine 204, resulting in a generator 205 generates electric power. Such power generation permits waste heat of the gas turbine fuel oil to be effectively available, leading to an increase generation efficiency.

Examples of the invention are described hereinafter.

EXAMPLE 1

Arabian light crude oil (S content: 1.77% by weight) which is most readily available in the art was used as feed oil, to thereby produce gas turbine fuel oil by means of the system shown in FIG. 1. More particularly, the crude oil was separated into light oil or light distillate 21 of 350° C. or less in boiling point and heavy oil or residue 22 above 350° C. in boiling point and a hydrogen gas pressure in the first hydrotreating step was set to be 45 kg/cm$^2$, resulting in gas turbine fuel oil being produced. Also, the vacuum distillation step provided a light oil matter 51 of 565° C. or less in boiling point (boiling point under an atmospheric pressure) and a heavy oil matter 52 having a boiling point above 565° C. by separation. In addition, a hydrogen gas pressure in the second hydrotreating step was set to be 55 kg/cm$^2$, to thereby obtain gas turbine fuel oil, which was then mixed with the gas turbine fuel oil produced in the first hydrotreating step. Any alkaline metal, alkaline earth metal, V and Pb were not detected in the gas turbine fuel oil thus mixed, which had a sulfur concentration of 430 ppm and viscosity of 1.3 cSt at 100° C. Yields of the gas turbine fuel oil based on the feed oil were 84%. It was found that the gas turbine fuel oil may be used for a gas turbine of which a gas turbine inlet temperature is 1300° C.

Simulation was practiced supposing that all energy obtained from the crude oil is converted into power generation (gas turbine power generation and boiler power generation). Station service power in a refinery plant, combined cycle gas turbine generation efficiency and boiler power generation efficiency were set to be 4%, 49% and 38%, respectively. Under such conditions, final power recovery was calculated while setting feeding of crude oil to the refinery plant at 100 units in terms of a heating value. As a result, it was found that power energy of 45.7 units in terms of a heating value can be recovered.

COMPARATIVE EXAMPLE 1

Gas turbine fuel oil was produced according to a procedure described in Japanese Patent Application Laid-Open Publication No. 207179/1994. In the Japanese publication, low-sulfur crude oil of which a salt concentration is adjusted to be 0.5 ppm or less is used as feed oil to produce gas turbine fuel oil having a sulfur concentration of 0.05% by weight or less. Arabian light oil has an increased sulfur content as compared with so-called low-sulfur crude oil. Thus, the crude oil was treated according to the procedure disclosed in the Japanese publication, resulting in petroleum fractions which have a sulfur concentration of 0.05% by weight or less being separated by distillation. Gas turbine fuel oil prepared according to the publication had only fractions extending from a light naphtha fraction to a kerosene fraction which have a boiling point region up to 245° C. Also, any alkaline metal, alkaline earth metal, V and Pb were not detected in the gas turbine fuel oil. Further, it had a sulfur concentration of about 470 ppm and viscosity of 0.3 cSt at 100° C., resulting in being increased in quality. However, yields of the gas turbine fuel oil based on the feed oil were as low as 24%.

Simulation was executed under substantially the same conditions as Example 1 described above, except that station service power was set to be 3%. Final power recovery was calculated while setting feeding of the crude oil to the refinery plant at 100 units in terms of a heating value. As a result, it was found that power energy recovery in terms of a heating value was as low as 39.5 units. Thus, the comparative example was highly inferior in energy availability to the present invention.

EXAMPLE 2

Of Middle East crude oil, Oman crude oil is known to have a relatively low sulfur content. Such Oman crude oil was used for producing gas turbine fuel oil by means of the system shown in FIG. 1. Oman crude oil has a sulfur concentration of 0.94% by weight, thus, it corresponds to low-sulfur crude oil described in Japanese Patent Application Laid-Open Publication No. 207179/1994. In Example 2, the crude oil was subject to atmospheric distillation, to thereby be separated into light oil or light distillate 21 of 350° C. or less in boiling point and heavy oil or residue 22 having a boiling point above 350° C. Also, a hydrogen gas pressure in the first hydrotreating step was set to be 40 kg/cm$^2$, resulting in gas turbine fuel oil being produced. Also, the vacuum distillation step provided a light oil matter 51 of 565° C. or less in boiling point (boiling point under an atmospheric pressure) and a heavy oil matter 52 having a boiling point above 565° C. by separation. In addition, a hydrogen gas pressure in the second hydrotreating step was set to be 50 kg/cm$^2$, to thereby obtain gas turbine fuel oil, which was then mixed with the gas turbine fuel oil produced in the first hydrotreating step. Any alkaline metal, alkaline earth metal, V and Pb were not detected in the gas turbine fuel oil thus mixed, which had a sulfur concentration of 410 ppm and viscosity of 1.1 cSt at 100° C. Yields of the gas turbine fuel oil based on the feed oil were 85%. It was found that the gas turbine fuel oil may be used for a gas turbine of which a gas turbine inlet temperature is 1300° C.

Simulation was practiced supposing that all energy obtained from the crude oil is converted into power generation (gas turbine power generation and boiler power generation). Station service power in a refinery plant, combined cycle gas turbine generation efficiency and boiler power generation efficiency were set to be 4%, 49% and 38%, respectively. Under such conditions, final power recovery was calculated while setting feeding of crude oil to the refinery plant at 100 units in terms of a heating value. As a result, it was found that power energy of 45.8 units in terms of a heating value can be recovered.

COMPARATIVE EXAMPLE 2

Gas turbine fuel oil was produced from the same Oman crude oil as in Example 2 described above according to a procedure described in Japanese Patent Application Laid-Open Publication No. 207179/1994. The production was carried out as in Comparative Example 1 described above. The crude oil was treated according to the procedure disclosed in the Japanese publication, resulting in petroleum fractions which have a sulfur concentration of 0.05% by weight or less being separated by distillation. Gas turbine fuel oil prepared according to the publication had only fractions extending from a light naphtha fraction to a kerosene fraction which have a boiling point region up to 250° C. Also, any alkaline metal, alkaline earth metal, V and Pb were not detected in the gas turbine fuel oil. Further, it had a sulfur concentration of about 490 ppm and viscosity of 0.45 cSt at 100° C. However, yields of the gas turbine fuel oil based on the feed oil were substantially reduced to a level as low as 35% irrespective of the fact that the feed oil is low-sulfur crude oil.

Simulation was executed under substantially the same conditions as Example 2, except that station service power was set to be 3%. Final power recovery was calculated while setting feeding of the crude oil to the refinery plant at 100 units in terms of a heating value. As a result, it was found that power energy recovery in terms of a heating value was as low as 40.7 units. Thus, the comparative example was highly inferior in energy availability to the present invention irrespective of the fact that the feed oil used was reduced in sulfur content.

Thus, in the present invention, crude oil is subject to the atmospheric distillation, to thereby be separated into light oil or light distillate and atmospheric residue oil. The light oil is then hydrotreated and the atmospheric residue oil is subject to the separation treatment or hydrotreating, resulting in a light oil matter being produced. The light oil matter thus obtained is then subject to hydrotreating, to thereby provide refined oil, which is used as the gas turbine fuel oil. Thus, the present invention permits the gas turbine fuel oil to be produced with increased yield while ensuring high quality of the fuel oil.

INDUSTRIAL APPLICABILITY

This invention permits the gas turbine fuel oil to be produced from feed oil with increased yields.

What is claimed is:

1. A method for producing gas turbine fuel oil from feed oil with increased yields, comprising:

an atmospheric distillation step of subjecting crude oil acting as said feed oil to atmospheric distillation to separate said crude oil into light oil and atmospheric residue oil;

a first hydrotreating step of contacting the light oil produced in said atmospheric distillation step with pressurized hydrogen in the presence of a catalyst in a lump, to thereby carry out an impurity removal treatment, resulting in obtaining refined oil;

a first separation step of separating said atmospheric residue oil into a light oil matter and a heavy oil matter;

said first separation step being selected from the group consisting of vacuum distillation, solvent deasphalting, thermal cracking and steam distillation; and a second hydrotreating step of contacting the light oil matter produced in said first separation step with pressurized hydrogen in the presence of a catalyst, to thereby carry out an impurity removal treatment, resulting in obtaining refined oil;

said refined oil produced in said first and second hydrotreating steps being the one and only product obtained and used as the gas turbine fuel oil;

the gas turbine fuel oil which is refined oil thus obtained in said first and second hydrotreating steps being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 65% or more based on said feed oil.

2. The method as defined in claim 1, wherein said first hydrotreating step and said second hydrotreating step are executed as a common step.

3. A method for producing gas turbine fuel oil from feed oil with increased yields, comprising:

an atmospheric distillation step of subjecting crude oil acting as said feed oil to atmospheric distillation to separate said crude oil into light oil and atmospheric residue oil;

a first hydrotreating step of contacting the light oil produced in said atmospheric distillation step with pressurized hydrogen in the presence of a catalyst in a lump, to thereby carry out an impurity removal treatment, resulting in obtaining refined oil;

a first separation step of separating said atmospheric residue oil into a light oil matter and a heavy oil matter;

said first separation step being selected from the group consisting of vacuum distillation, solvent deasphalting, thermal cracking and steam distillation;

a second hydrotreating step of contacting the light oil matter produced in said first separation step with pressurized hydrogen in the presence of a catalyst, to thereby carry out an impurity removal treatment, resulting in obtaining refined oil;

a second separation step of separating said heavy oil matter produced in said first separation step into a light oil matter and a heavy oil matter;

said second separation step being selected from the group consisting of solvent deasphalting and thermal cracking; and a third hydrotreating step of contacting the light oil matter produced in said second separation step with pressurized hydrogen in the presence of a catalyst, to thereby carry out an impurity removal treatment, resulting in obtaining refined oil;

said refined oil produced in said first, second and third hydrotreating steps being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less, and sulfur in an amount of 500 ppm or less, and being produced with yields of 65% or more based on said feed oil.

4. The method as defined in claim 3, wherein at least two of said first, second and third hydrotreating steps are executed as a common step.

5. The method as defined in claim 3, wherein the heavy oil matter produced in the second separating step is used as fuel oil for a boiler.

6. The method as defined in claim 1, further comprising a third hydrotreating step of contacting the heavy oil matter produced in said first separation step with pressurized hydrogen in the presence of a catalyst, to thereby carry out an impurity removal treatment and cracking a part of said heavy oil matter, resulting in obtaining refined oil and a heavy oil matter, said refined oil produced in said third hydrotreating step being used as the gas turbine fuel oil.

7. The method as defined in claim 6, wherein said heavy oil matter produced in said third hydrotreating step is used as fuel oil for a boiler.

8. The method as defined in claim 1, wherein the gas turbine fuel oil is further subject to atmospheric distillation, to thereby provide light gas turbine fuel oil and heavy gas turbine fuel oil heavier than the light gas turbine fuel oil.

9. The method as defined in claim 1, wherein the heavy oil matter produced in the first separation step is used as fuel oil for a boiler.

10. The method as defined in claim 1, wherein said feed oil is subject to a desalting treatment prior to said atmospheric distillation step.

11. The method as defined in claim 1, wherein said heavy oil matter produced on the basis of said feed oil is partially oxidized by oxygen to produce hydrogen, which is used in said hydrotreating steps.

12. A method for producing gas turbine fuel oil from feed oil with increased yields, comprising:

an atmospheric distillation step of subjecting crude oil acting as said feed oil to atmospheric distillation to separate said crude oil into light oil and atmospheric residue oil;

a first hydrotreating step of contacting the light oil produced in said atmospheric distillation step with pressurized hydrogen in the presence of a catalyst in a lump, to thereby carry out an impurity removal treatment, resulting in obtaining refined oil; and a second hydrotreating step of contacting said atmospheric residue oil with pressurized hydrogen in the presence of a catalyst, to thereby carry out an impurity removal treatment and cracking a part of a heavy oil matter, resulting in obtaining refined oil and a heavy oil matter;

said refined oil produced in said first and second hydrotreating steps being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 65% or more based on said feed oil.

13. A method for producing gas turbine fuel oil from feed oil with increased yields, comprising:

an atmospheric distillation step of subjecting crude oil acting as said feed oil to atmospheric distillation to separate said crude oil into light oil and atmospheric residue oil;

a first hydrotreating step of contacting the light oil produced in said atmospheric distillation step with pressurized hydrogen in the presence of a catalyst in a lump, to thereby carry out an impurity removal treatment, resulting in obtaining refined oil;

a second hydrotreating step of contacting said atmospheric residue oil with pressurized hydrogen in the presence of a catalyst, to thereby carry out an impurity removal treatment and cracking a part of a heavy oil matter, resulting in obtaining refined oil and a heavy oil matter;

a first separation step of separating said heavy oil matter produced in said second hydrotreating step into a light oil matter and a heavy oil matter; and said first separation step being selected from the group consisting of vacuum distillation, solvent deasphalting and thermal cracking;

said refined oil produced in said first and second hydrotreating steps and said light oil matter produced in said first separation step being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 65% or more based on said feed oil.

14. A method for producing gas turbine fuel oil from feed oil with increased yields, comprising:

a first separation step of separating heavy feed oil consisting of atmospheric residue oil obtained by atmospheric distillation of crude oil and/or heavy oil into a light oil matter and a heavy oil matter;

said first separation step being selected from the group consisting of vacuum distillation, solvent deasphalting, thermal cracking and steam distillation; and a first hydrotreating step of contacting said light oil matter produced in said first separation step with pressurized hydrogen in the presence of a catalyst, to thereby carry out an impurity removal treatment, resulting in obtaining refined oil;

said refined oil produced in said first hydrotreating step being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 40% or more based on said heavy feed oil.

15. A method for producing gas turbine fuel oil from feed oil with increased yields, comprising:

a first separation step of separating heavy feed oil consisting of atmospheric residue oil obtained by atmospheric distillation of crude oil and/or heavy oil into a light oil matter and a heavy oil matter;

said first separation step being selected from the group consisting of vacuum distillation, solvent deasphalting, thermal cracking and steam distillation;

a first hydrotreating step of contacting said light oil matter produced in said first separation step with pressurized hydrogen in the presence of a catalyst, to thereby carry out an impurity removal treatment, resulting in obtaining refined oil;

a second separation step of separating said heavy oil matter produced in said first separation step into a light oil matter and a heavy oil matter;

said second separation step being selected from the group consisting of solvent deasphalting and thermal cracking; and a second hydrotreating step of contacting said light oil matter produced in said second separation step with pressurized hydrogen in the presence of a catalyst, to thereby carry out an impurity removal treatment, resulting in obtaining refined oil;

said refined oil produced in said first and second hydrotreating steps being the one and only product obtained and used as the gas turbine fuel oil; and the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 40% or more based on said heavy feed oil.

16. A method for producing gas turbine fuel oil from feed oil with increased yields, comprising:

a first separation step of separating heavy feed oil consisting of atmospheric residue oil obtained by atmospheric distillation of crude oil and/or heavy oil into a light oil matter and a heavy oil matter;

said first separation step being selected from the group consisting of vacuum distillation, solvent deasphalting, thermal cracking and steam distillation; and a first hydrotreating step of contacting said light oil matter produced in said first separation step with pressurized hydrogen in the presence of a catalyst, to thereby carry out an impurity removal treatment, resulting in obtaining refined oil; and a second hydrotreating step of contacting said heavy oil matter produced in said first separation step with pressurized hydrogen in the presence of a catalyst, to thereby carry out an impurity removal treatment and cracking a part of said heavy oil matter, resulting in obtaining refined oil and a heavy oil matter;

said refined oil produced in said first and second hydrotreating steps being the one and only product obtained and used as the gas turbine fuel oil; and the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 40% or more based on said heavy feed oil.

17. A method for producing gas turbine fuel oil from feed oil with increased yields, comprising:

a hydrotreating step of contacting heavy feed oil consisting of atmospheric residue oil obtained by atmospheric distillation of crude oil and/or heavy oil with pressurized hydrogen in the presence of a catalyst, to thereby carry out an impurity removal treatment and cracking a part of a heavy oil matter, resulting in obtaining refined oil and a heavy oil matter;

said refined oil produced in said hydrotreating step being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 40% or more based on said heavy feed oil.

18. A method for producing gas turbine fuel oil from feed oil with increased yields, comprising:

a hydrotreating step of contacting heavy feed oil consisting of atmospheric residue oil obtained by atmospheric distillation of crude oil and/or heavy oil with pressurized hydrogen in the presence of a catalyst, to thereby carry out an impurity removal treatment and cracking a part of a heavy oil matter, resulting in obtaining refined oil and a heavy oil matter;

a separation step of separating said heavy oil matter produced in said hydrotreating step into a light oil matter and a heavy oil matter; and said separation step being selected from the group consisting of vacuum distillation, solvent deasphalting and thermal cracking;

said refined oil produced in said hydrotreating step and said light oil matter produced in said separation step being the one and only product obtained and used as the gas turbine fuel oil;

the gas turbine fuel oil which is refined oil thus obtained being 4 cSt or less in viscosity at 100° C., containing alkaline metal in an amount of 1 ppm or less, lead in an amount of 1 ppm or less, V in an amount of 0.5 ppm or less, Ca in an amount of 2 ppm or less and sulfur in an amount of 500 ppm or less, and being produced with yields of 40% or more based on said heavy feed oil.

* * * * *